US011654694B2

(12) United States Patent
Gerstner

(10) Patent No.: US 11,654,694 B2
(45) Date of Patent: May 23, 2023

(54) METHOD AND PRINTING DEVICE FOR INFLUENCING AN OPTICAL PROPERTY OF A VARNISH LAYER TO BE APPLIED ONTO A PRINTED RECORDING MEDIUM

(71) Applicant: Canon Production Printing Holding B.V., Venlo (NL)

(72) Inventor: Albrecht Gerstner, Oberbergkirchen (DE)

(73) Assignee: Canon Production Printing Holding B.V., Venlo (NL)

( * ) Notice: Subject to any disclaimer, the term of this patent is extended or adjusted under 35 U.S.C. 154(b) by 85 days.

(21) Appl. No.: 17/470,365

(22) Filed: Sep. 9, 2021

(65) Prior Publication Data

US 2022/0080748 A1 Mar. 17, 2022

(30) Foreign Application Priority Data

Sep. 11, 2020 (DE) ..... 102020123690.5

(51) Int. Cl.
*B41J 2/21* (2006.01)
*B41J 11/00* (2006.01)

(52) U.S. Cl.
CPC ..... *B41J 2/2114* (2013.01); *B41J 11/0015* (2013.01)

(58) Field of Classification Search
CPC .. B41J 2/2114; B41J 11/0015; B41M 5/0017; B41M 7/00; B41M 7/0045
See application file for complete search history.

(56) References Cited

U.S. PATENT DOCUMENTS

2019/0023046 A1 1/2019 Levin et al.

FOREIGN PATENT DOCUMENTS

| | | | | |
|---|---|---|---|---|
| DE | 102017101527 A1 | | 7/2018 | |
| DE | 112017005444 T5 | | 8/2019 | |
| JP | 2010106275 A | * | 5/2010 | ..... B05D 3/0209 |
| WO | 2013126869 A1 | | 8/2013 | |

OTHER PUBLICATIONS

German Search Report dated Apr. 29, 2021, Application No. 10 2020 123 690.5.

* cited by examiner

*Primary Examiner* — Justin Seo
(74) *Attorney, Agent, or Firm* — The Webb Law Firm

(57) ABSTRACT

In a method and a printing device for influencing an optical property of a varnish layer to be applied onto a printed recording medium, a coating substance is applied onto the recording medium by digital printing before the printing of at least one color separation of the print image on said recording medium. The quantity of the coating substance applied per area unit may be adjusted depending on the desired optical property of the varnish layer to be applied later.

16 Claims, 5 Drawing Sheets

METHOD AND PRINTING DEVICE FOR INFLUENCING AN OPTICAL PROPERTY OF A VARNISH LAYER TO BE APPLIED ONTO A PRINTED RECORDING MEDIUM

CROSS REFERENCE TO RELATED APPLICATIONS

This patent application claims priority to German Patent Application No. 102020123690.5, filed Sep. 11, 2020, which is incorporated herein by reference in its entirety.

BACKGROUND

Field

The disclosure relates to a method for influencing an optical property of a varnish layer to be applied onto a recording medium printed to with a print image with the aid of a printing device, in particular with the aid of an inkjet printing device. Before printing at least one color separation of the print image onto the recording medium, a coating substance is applied onto the recording medium by means of digital printing. The disclosure also relates to a printing device for printing to a recording medium, via which the optical property of a varnish layer to be applied onto a recording medium printed to with a print image with the aid of a printing device, in particular with the aid of an inkjet printing device, can be influenced.

Related Art

The disclosure is in particular used in digital printing, which is also referred to as "Direct Digital Printing" (DDP) or Computer-to-Print in international parlance. Digital printing refers to a group of printing methods in which the print image is transferred directly by a computer from a file or a print data stream to a printing device without a static printing form being used. In generating print images with the aid of a digital printing device, print dots are generated per line and per column depending on the print data. The print dots generated in the line and column raster are also referred to as raster points, as dots, or as pixels. To generate a raster dot in a desired color, color dots of individual color separations in this raster are printed and, at least to the observer, a mixed color is optically generated. The column and line raster thus defines dot regions in which dots on the recording medium are then generated.

What are known as analog varnishing plants are known that generate a full-area varnish layer on a printed medium. A gloss level of the generated varnish layer results depending on the quantity and type of the varnish and the medium that is used for applying the varnish. This gloss level is uniform and consistent over the entire coated surface. A partial area of the recording medium may be left free from application of the varnish layer by cutting out or omitting contact regions of a printing plate or of a printing cylinder for application of the varnish. For this, regions of the printing plate or of the printing cylinder may be left blank so that the printing plate or the printing cylinder does not contact the recording medium in these regions. Due to the static embodiment of the printing plate or of the printing cylinder, varnish images generated in such a manner are identical on every print page and may only be modified if the printing plate or the printing cylinder is exchanged for different printing plates or printing cylinders. A variation of the gloss level of the varnish in different regions of the recording medium is possibly only via a second, likewise analog varnish application, wherein then a different quantity, a different varnish type, or a different medium is used to apply the varnish.

An analog varnishing plant generates full-area varnish layers on print images or packagings. Such a varnishing plant is, for example, a commercially available flexographic printing group or a flexographic plate, a chamber blade, and an anilox roller. The varnish is thereby applied by means of chamber blade and anilox roller onto the flexographic plate, the print roller, or the blanket. The blade removes the varnish from the anilox roller again to the extent that a uniform, consistently dosed quantity of varnish is present on the anilox roller after the blade. The varnish quantity is thereby defined across the volume of the raster cups or structures of the anilox roller. The varnish is subsequently applied onto a printing cylinder or a blanket or a flexographic plate. A first separation process of the varnish layer present on the flexographic plate, the printing cylinder, or the blanket thereby takes place. A transfer of the varnish onto the recording medium, for example paper or cardboard articles, then takes place by means of the printing cylinder or the blanket, wherein a second separation process of the varnish occurs in this transfer. After the transfer, the recording medium is coated over its entire area with a consistent varnish layer.

As was already mentioned, individual regions of the varnish surface may also left clear. For this, regions in the printing cylinder or blanket are removed so that there no varnish may be transferred from the printing cylinder or blanket onto the recording medium. As a result, regions with a varnish layer and regions without varnish layer are created. The gloss level or the varnish layer applied in such a manner is identical at every location of the varnish layer. Discrepancies may arise due to non-uniform application or disturbances of the varnish transfer and of the recording medium. Conventional varnishing plants thus may apply (100%) or not apply (0%) a varnish layer at established, stationary locations. In many applications, a full-area varnish layer is generated in which the blanket or the printing cylinder has no recesses, such that the surface of the recording medium is varnished over its entire surface, i.e. at 100%. The regions with the varnish layer thus have the same, invariant varnish quantity and the same gloss level. If a recording medium with different gloss regions should be generated, two or even more varnishing processes are necessary. An individual control of the gloss level of individual regions on different print pages is not possible. Rather, the generated varnish layer and the gloss image of the varnish layer on the print images coated one after in another is identical, so that copies of the varnish layer are generated on all successively printed print pages.

In digital printing, in particular in digital inkjet printing, a coating substance—what is known as a primer—is applied onto the recording medium before the printing of a color separation of the print image. This coating substance is likewise applied onto the recording medium as a uniform layer over the entire area, across the complete printing region of the recording medium, by means of digital printing, preferably with the aid of a primer inkjet printing unit. For example, the primer may be an aqueous saline solution which reacts with the colored ink of an ink inkjet station and prevents a flocculation or running of the color, so that the ink adheres to the recording medium directly upon being printed on. The primer also prevents the bleeding of the inks of different color separations. Such a primer is normally colorless, or invisible or imperceptible on the recording medium in the printed state. In this way, the print image is not negatively influenced. Such a primer application is known from the document DE 10 2017 101 527 A1, for example. A very sharp print image is achieved via the primer.

Polyurethane-based primers are also known from the document WO 2013/126869 A1.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
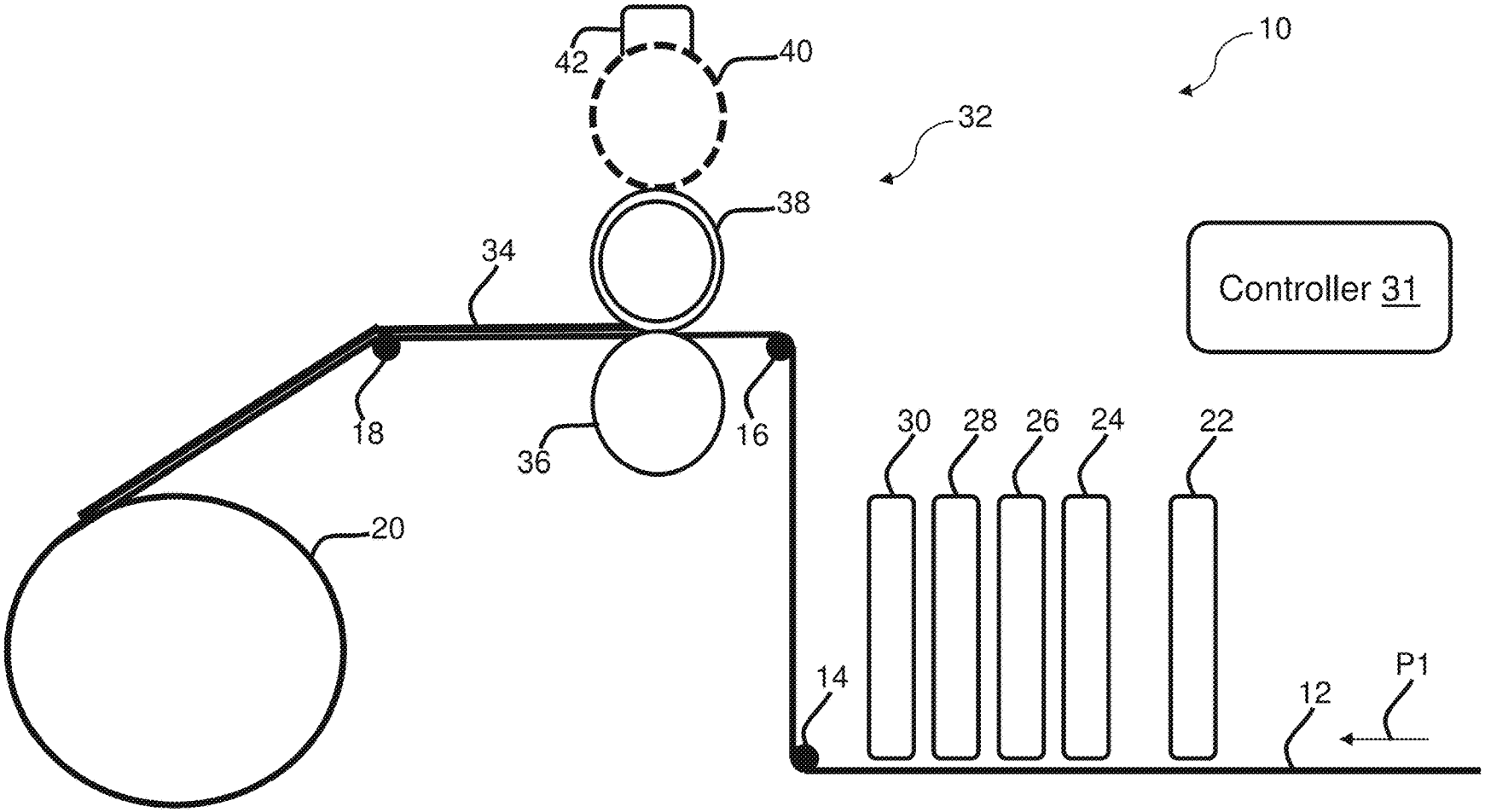
FIG. 1 is a schematic depiction of a printing device for printing to a recording medium with a print image, and of an arrangement for subsequently applying a varnish layer onto the printed recording medium, according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

It is an object of the disclosure to specify a method and a printing device for influencing an optical property of a varnish layer to be applied onto a recording medium to be printed to.

Via a method according to the disclosure, it is achieved that coating substance applied before the application of the color separation or color separations is applied onto the recording medium not as a uniform layer, but rather in different quantities per unit of area, depending on the desired optical property of the varnish layer to be applied later. Individually different gloss properties of the varnish layer that is to be applied later can hereby be generated for each print image. The varnish layer itself may continue to be applied conventionally as a uniform varnish layer on the printed recording medium. Different gloss levels of the varnish layer to be applied may be achieved via the different optical properties. Due to their roughness, matte surfaces especially are also suitable for gluing with adhesive. These locations then do not need to be left out in the generation of the varnish layer, as in the prior art.

Due to the different quantity of the coating substance per area unit that is applied by means of digital printing, surface regions having different surface energy are generated that then lead to a different roughness of the varnish layer applied later. The surface energy is hereby a measure of the energy that is necessary to break the chemical bond if a new surface of a fluid or of a solid body is generated. The surface energy is defined as an energy that must be applied to generate the surface per area unit.

Via digital printing of the coating substance, a digital print image may be generated that is then visible after application of the varnish layer as a gloss image.

The print image of the coating substance may modified, just like the printing of the color separations by means of digital control, from print side to print side on a recording medium in the form of a web, or from sheet to sheet given recording media in the form of pages. The printing unit, in particular a print bar having a plurality of print heads for printing the coating substance, may be controlled just like a printing unit or a print bar for printing a color separation. The quantity of coating substance applied per area unit may therewith be simply established in the range from 0% (no coating substance is applied) to 100% (the maximum quantity of coating substance that can be applied per area unit is applied with the aid of the printing unit). Since the coating substance is applied with the aid of print heads of the print bar, in particular with the aid of inkjet print heads, any arbitrary pattern that is possible within the scope of the resolution of the print heads may be generated. Images of the coating substance having a resolution of 600 dpi given print heads having a resolution of 600 dpi, and 1200 dpi given print heads having a resolution of 1200 dpi, can hereby be printed. The applied coating substance serves both as a primer for preventing the flowing of the applied color of the color separation, in particular of the applied ink, and to form a desired optical property of the varnish layer to be applied in different surface regions in a subsequent analog varnishing process. An analog varnishing process is hereby the application of a uniform varnish layer with the aid of an offset print group or a flexographic print group. Alternatively, the varnish layer may also be applied via a spraying process.

Via the individual control of the quantity of coating substance that is to be applied per area unit, a digital print image of the coating substance on the recording medium is generated that is visually invisible to the eye of the observer. An image information in invisible form has therewith been printed onto the recording medium. This information is stored by the different quantity of the coating substance per area unit, and in the subsequently applied varnish layer then leads to different optical properties, meaning that, in spite of a varnish layer applied over the entire surface, a visually perceptible image appears in the varnish layer due to different optical properties of the varnish layer that depend on the applied quantity of the coating substance per area unit.

The image information is thus visible in the varnish layer applied later. Different gloss levels are thus created, depending on the quantity of applied coating substance per area unit. In regions having a large quantity of coating substance, an uneven, rough varnish structure is created. The light is thereby scattered on the varnish surface. A diffuse reflection takes place. The image appears more matte. In image regions without coating substance, or having a small quantity of coating substance per area unit, the varnish layer has a smoother surface, whereby the light is not scattered or is only slightly scattered at the surface so that a higher gloss is generated. The gloss of the varnish layer may thus modify the optical property or the optical impression of the print product like an additional color, in that glossy and matt regions or regions having different reflection properties are generated. As is typical in digital printing, this may be arbitrarily varied from print side to print side or print sheet to print sheet. In particular, edge effects may be emphasized, or matte and glossy regions may be generated that are comparable to a watermark in order to make additional background information visible. This may in particular also be used as a security feature of the generated print product, since the formation of different optical properties of a varnish layer cannot be reproduced by simple copier systems.

Via a targeted variation of the surface structure of the varnish layer, it is also possible to specifically improve the adhesion properties of the print product in defined regions. This takes place in particular in that a rough surface improves the adhesion properties, since a rough surface has a greater surface area than a smooth surface. The mechanical adhesion is hereby improved.

Conventionally, leaving such regions clear often needed to take place in a complex manner, via a change of the printing cylinder or of the printing plate or of the blanket at the corresponding locations. For this, in particular correspondingly large printing cylinders or blankets would need to be provided whose extent needed to correspond to the length of a print side. Via the disclosure, surfaces to be glued may be provided in a targeted manner with such a quantity of coating substance that the subsequently applied varnish layer has a rough surface.

By generating a print image of the coating substance, the gloss information of the varnish layer to be generated may be durably stored before the application of said varnish layer, so that the varnish layer may even be applied at a much later point in time, in particular even at a different location. The varnishing process may thus occur at an arbitrary point in time after the printing.

The application of the varnish layer may be implemented via a commercially available flexographic print group; the purely analog varnish group/flexographic print group therefore provides a uniform varnish layer and applies it onto the recording medium, and thereby forms a gloss level depending on the print image of the coating substance. The information contained in the print image of the coating substance is thus "developed". A very inexpensive standard varnish may be used to generate the varnish layer. Special printable varnishes, which may be printed onto the printed recording medium with the aid of inkjet printing units, are not necessary.

The applied quantity of coating substance modifies the energetic state of the phase boundary of the recording medium with respect to the fluid varnish. The increase in the surface energy due to the application of the coating substance, in particular due to the application of high quantities of the coating substance, changes the wettability of the surface of the recording medium and the separation of the varnish layer upon transfer from the printing roller or the blanket for application of the varnish layer onto the printed recording medium. The varnish dries within a short time after application. Drying units, in particular heating units and/or blowers, may be used for this so that varnish is formed as a solid layer.

The structure of the varnish surface is dependent on the quantity of the coating substance applied per area unit and remaining after drying. The greater the quantity of applied coating substance, the more uneven the surface of the applied varnish layer. The surface of the varnish layer is then brought into a solid phase with a high roughness or corrugation structure via drying of the varnish layer. This high roughness leads to a diffuse light reflection, and therewith appears to be more matte to the observer. The optical gloss may be increased by reducing the quantity of the applied coating substance. In tests, the highest gloss was achieved in regions without coating substance.

Systems configured to generate a varnish layer with the aid of inkjet print heads require special varnishes for inkjet heads that must satisfy special requirements with respect to their viscosity, solids content, and/or pH value. These varnishes are UV-drying and in particular contain photoinitiators, and are typically cured with the aid of mercury vapor lamps or LED systems. Special measures for operating safety are also required for these. This manner of generating a varnish layer on a printed recording medium is relatively expensive, especially if large areas are to be provided with a varnish layer. However, such systems may also apply varnish in different quantities.

By contrast, inexpensive water-based varnishes may be used by analog varnishing with the aid of printing rollers, blankets, or flexographic print groups. Said water-based varnishes may be dried with hot air or infrared radiators. Via the method according to the disclosure, the gloss level may be continuously varied via the quantity of the coating substance applied onto the area unit. The most matte setting is achieved given the maximum quantity of coating substance that can be applied per area unit. The maximum quantity per area unit is predetermined, upon application with the aid of inkjet printing units, by the print head that applies the coating substance. After the application via the printing and after the drying, the coating substance is found in dried, solid form on the recording medium together with the visible print image. The varnish layer may then be applied immediately following or also with a separation in time and space, as has already been explained. The recording medium may in particular be a paper web or a cardboard article, for example corrugated board.

A second aspect of the disclosure relates to a printing device for influencing the optical property of a varnish layer to be applied onto a recording medium printed to with a print image with the aid of a printing device, in particular with the aid of an inkjet printing device. A first digital printing unit applies a coating substance onto the recording medium. A second digital printing unit prints at least one color separation of a print image to be generated onto the recording medium.

The quantity of the coating substance applied per area unit with the aid of the first printing unit is set or controlled in particular by a controller, depending on the desired optical property of a varnish layer to be applied later.

The printing device is in particular suitable to implement a method according to the disclosure. The controller hereby accordingly controls the printing units so that a print image of the coating substance is printed with regions having different quantities of the coating substance per area unit. Upon later application of a uniform varnish layer, this has different optical properties depending on the quantity of coating substance applied per area unit, said coating substance having been applied by means of digital printing with the aid of the first printing unit.

The coating substance is in particular a primer that reduces or avoids a bleeding of colorants of different color separations of the print image to be printed and a running of the applied colorant of individual color separations on the recording medium. The coating substance may contain an aqueous saline solution or be an aqueous saline solution. The saline solution contains in particular magnesium nitrate or magnesium sulfate. The coating substance may also alternatively or additionally contain polyurethane or be a polyurethane-based coating substance. The coating substance generates a colorless layer on the recording medium.

FIG. 1 shows a schematic depiction of a printing device 10 for printing to a recording medium 12 with a print image, and of an arrangement 32 for subsequently applying a varnish layer 34 onto the printed recording medium 12, according to a first embodiment. The printing device 10 has a plurality of digital printing units 22 to 33 that, in the present exemplary embodiment, are designed as inkjet printing units 22 to 30. In other embodiments, the digital printing units may also operate according to a different printing principle.

In the present exemplary embodiment, each printing unit 22 to 30 comprises a print bar having a plurality of inkjet print heads that are arranged such that the print bar and print heads, which are arranged so as to be stationary, print to the recording medium 12 across the entire printing width. For printing with the aid of the printing units 22 to 30, the recording medium 12 is directed past the printing units 22 to 30 in the direction of the arrow P1, and in the further process is transported via the guide rollers 14, 16, 18 through the printing device 10, wherein the recording medium 12 printed to with a print image and provided with a varnish layer 34 is then taken up at a roll 20. The printing units 24, 26, 28, 30 generate a respective raster image of a color separation on the recording medium, wherein they are activated by a controller 31. The controller 31 may include a raster image processor. In an exemplary embodiment, the controller 31 includes processing circuitry that is configured to perform one or more functions of the controller 31, including controlling the operation of the printing device 10, controlling one or more components of the printing device 10, controlling arrangement 32 and/or 50, and/or controlling the activation of the printing units 24, 26, 28, 30. Although not shown, the controller 31 is connected to the controller components of the printing device 10 (e.g. the printing units 24, 26, 28, 30) via wired connections and/or wirelessly.

The printing unit 24 may hereby generate a color separation in the color yellow; the printing unit 26 may hereby generate a color separation in the color magenta; the printing unit 28 may hereby generate a color separation in the color cyan; and the printing unit 30 may hereby generate a color separation in the color black. The color order described here may be arranged differently. The printing unit 22 serves to apply a coating substance. In the present exemplary embodiment, this coating substance is a primer that reduces or prevents a bleeding of colorants of the color separations of the print image to be printed, said color separations being subsequently generated by the printing units 24 to 30, as well as a running of the applied colorant of individual color separations on the recording medium 12.

The coating substance may contain an aqueous saline solution or be an aqueous saline solution. The aqueous saline solution contains magnesium nitrate or magnesium sulfate, in particular. Alternatively or additionally, the coating substance may also contain polyurethane or be a coating substance based on polyurethane.

The coating substance generates a colorless layer on the recording medium 12. The printing unit 22 for application of the coating substance is likewise controlled by the controller 31. The controller 31 is configured to control the printing unit 22 such that, depending on the desired optical property of the varnish layer 34 to be subsequently applied (with the aid of the arrangement 32 for applying the varnish layer 34), the proportion of the quantity of coating substance that is to be applied per area unit is adjustable between 0% and 100%, wherein 100% is the maximum quantity of coating substance that can be applied per area unit with the aid of the printing unit 22. The printing unit 22 thus generates a raster image of the coating substance that subsequently cannot be visually detected by an observer. However, this raster image influences the gloss level of the varnish layer 34 in the respective surface region after application of said varnish layer 34, depending on the quantity of the applied coating substance per area unit.

The arrangement (varnish applicator) 32 for applying the varnish layer 34 comprises a varnish reserve 42 for inking an anilox roller 40. A blade (not shown) delimits the quantity of the varnish layer applied onto the anilox roller 40 so that a uniform varnish layer is present on the anilox roller 40 in a contact region between said anilox roller 40 and a printing roller 38, whereby a uniform varnish layer is generated on the shell surface of the printing roller 38. The varnish layer is then transferred from the printing roller 38 onto the printed recording medium 12. In the transfer region, the printing roller 38 is arranged opposite a contact pressure roller 36.

As has already been mentioned above, the gloss level of the varnish layer 34 is dependent on the quantity of coating substance applied per area unit with the aid of the printing unit 22. The resolution of the printing unit 22 is preferably the same resolution of the printing units 24 to 30. In other embodiments, the printing unit 22 may also have a lower resolution than the printing units 24 to 30. In particular, the printing unit 22 may have a resolution of 300 dpi, 600 dpi, or 1200 dpi. Printing units proven for the application of the coating substance can hereby be used.

Figure 2:
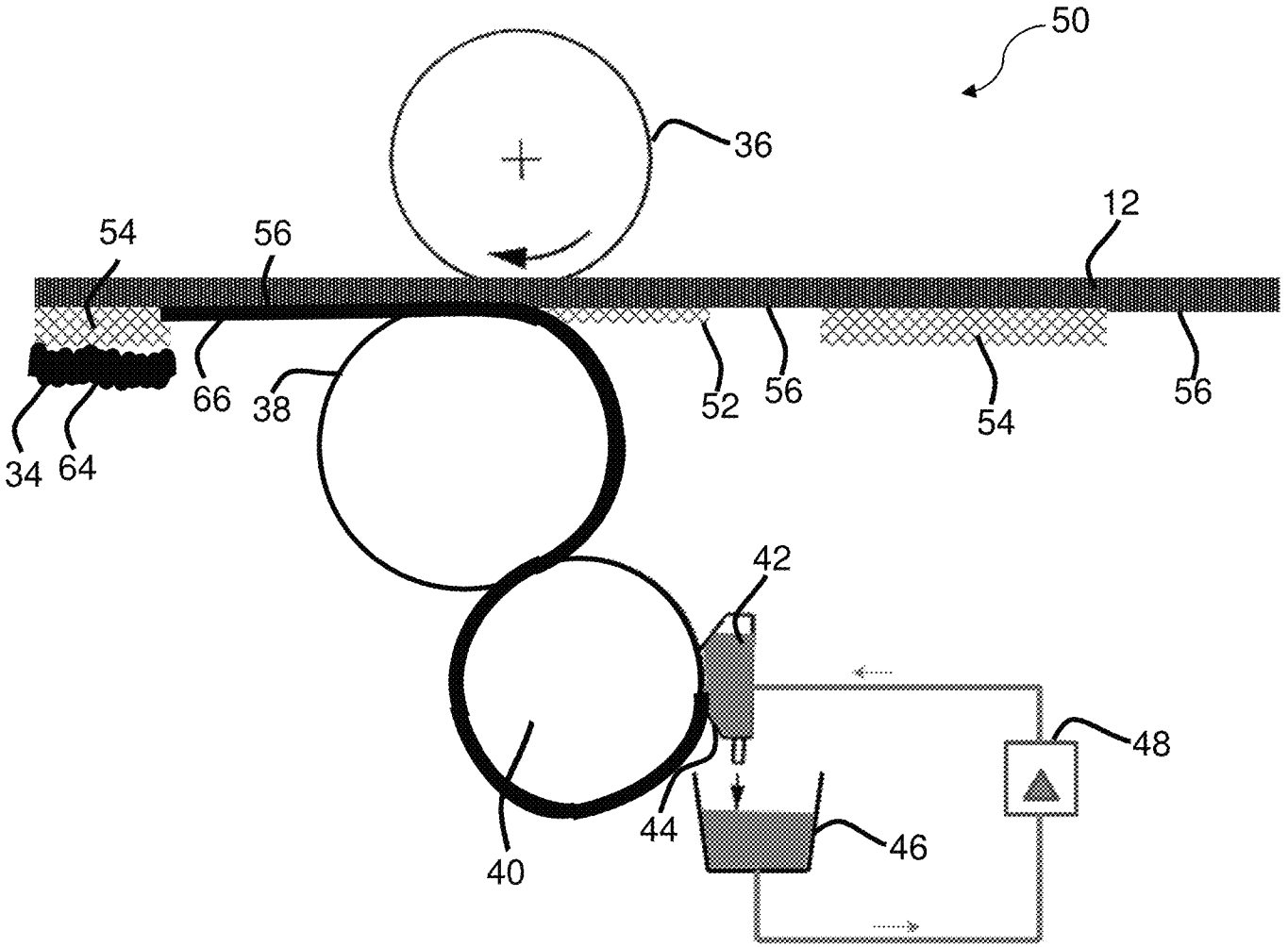
FIG. 2 is a schematic depiction, in partial section, of an arrangement for applying a varnish layer onto a printed recording medium, according to an exemplary embodiment.

FIG. 2 shows a schematic depiction, in partial section, of an arrangement (varnish applicator) 50 for applying a varnish layer onto a printed recording medium 12, according to a second embodiment. In this second embodiment—in contrast to the first embodiment according to FIG. 1—the varnish layer is applied onto the underside of the printed recording medium. In particular, the arrangement 50 is an arrangement 50 spatially independent of printing units 22 to 30, with which a printed recording medium 12 may subsequently be provided with a varnish layer 34. In the embodiment according to FIG. 2, regions 52, 54 of the recording medium 12 have been printed to with different quantities of the coating substance, by contrast to which the regions 56 of the recording medium 12 have not been printed to with coating substance. The coating substance is printed onto the underside of the recording medium 12, wherein approximately 30% of the maximum quantity of the coating substance is applied in region 52, and the maximum quantity of the coating substance is applied in regions 54. In the same manner as given the arrangement 32 according to FIG. 1, the arrangement 50 has an anilox roller 40 that is inked with the aid of a varnish reserve 42, wherein the layer thickness of the varnish layer applied onto the anilox roller 40 is delimited by a blade 44. The varnish stripped off by the blade 44 is captured by a capture reservoir 46 and supplied to the varnish reserve 42 again with the aid of a pump 48.

As given the arrangement 32 according to FIG. 1, the varnish layer is transferred from the anilox roller 40 onto the print roller 38, and from the print roller 38 onto the printed recording medium 12. The recording medium 12 is printed to with at least one print image of the coating substance. No color separations of a print image are present in the portion of the recording medium 12 that is depicted in FIG. 2.

In the region of the recording medium 12 that has already passed the arrangement 50, a varnish layer 64 with an uneven surface has been generated with 100% coating substance on the portion 54. This uneven surface leads to a diffuse reflection of incident light, so that this layer 64 later appears to be more matte. In the region 56, there is no coating substance between recording medium 12 and varnish layer 34, so that the varnish layer 34 in this region 66 has a very smooth surface, so that a less diffuse reflection of the incident light by the varnish layer 34 takes place in the region 66 than in the region 64 of the varnish layer 34. The region 66 thus has a high gloss. A varnish layer 34 subsequently applied onto the region 52 has a medium gloss in region 62 by comparison to regions 64, 66.

Figure 3:
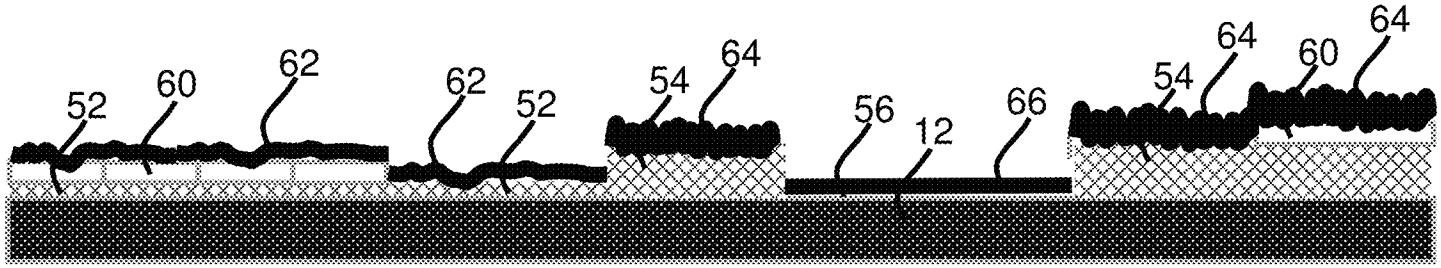
FIG. 3 is a sectional presentation of a printed recording medium having a varnish layer applied after printing, according to an exemplary embodiment.

FIG. 3 shows a sectional presentation of a printed recording medium 12 with a varnish layer 34 applied by means of the arrangement 32 or 50 after printing. Some regions of the recording medium 12 provided with coating substance were hereby printed to with a print image, wherein the print image generated by the color separations is designated with the reference character 60. The regions 52 of the recording medium 12 are provided with a first quantity of coating substance per area unit. The regions 54 of the recording medium 12 are provided with a second quantity of coating substance per area unit, and the regions 56 of the recording medium are without coating substance. The regions 62 of the varnish layer 34 have a first gloss property; the regions 64 of the varnish layer 34 have a second gloss property; and the regions 66 of the varnish layer have a third gloss property. The regions 64 have a starkly diffuse reflection; the regions 62 have a medium diffuse reflection; and the regions 66 have a slightly diffuse reflection, such that to an observer the regions 66 are perceived to be glossy, the regions 64 are perceived to be matte, and the regions 62 are perceived to be at an intermediate level between matte and glossy.

Figure 4:
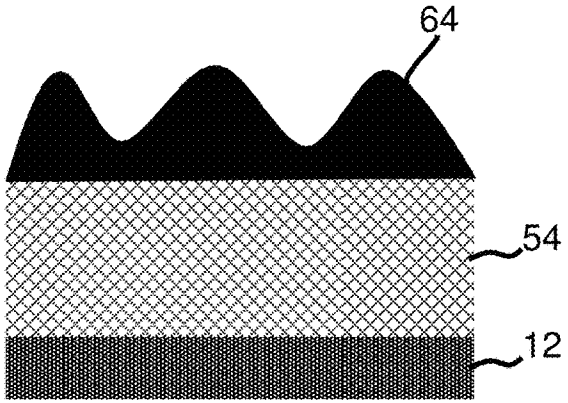
FIG. 4 is a sectional presentation of a segment of a printed recording medium, with a varnish layer having low optical gloss applied after printing, according to an exemplary embodiment.

FIG. 4 shows a sectional presentation of a portion of a printed recording medium 12 having a varnish layer 34 with low optical gloss, applied after printing.

Figure 5:
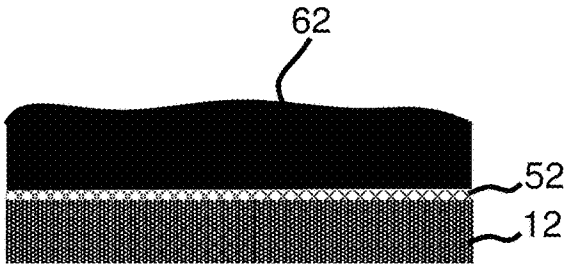
FIG. 5 is a sectional presentation of a segment of a printed recording medium, with a varnish layer having high optical gloss applied after printing, according to an exemplary embodiment.

FIG. 5 shows a sectional presentation of a portion of a printed recording medium 12 having a varnish layer 34 with high optical gloss, applied after printing.

Figure 6:
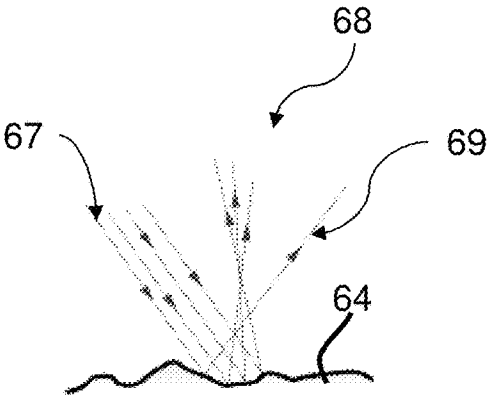
FIG. 6 is a schematic depiction of the diffuse reflection of light at the surface of the varnish layer with low gloss, according to an exemplary embodiment.

FIG. 6 shows a schematic depiction of the light path 68. The incident light rays 67 lead to a diffuse reflection of light on the surface of the varnish layer 34 in the region 64 with low gloss, so that the reflecting light rays 69 point in different directions.

Figure 7:
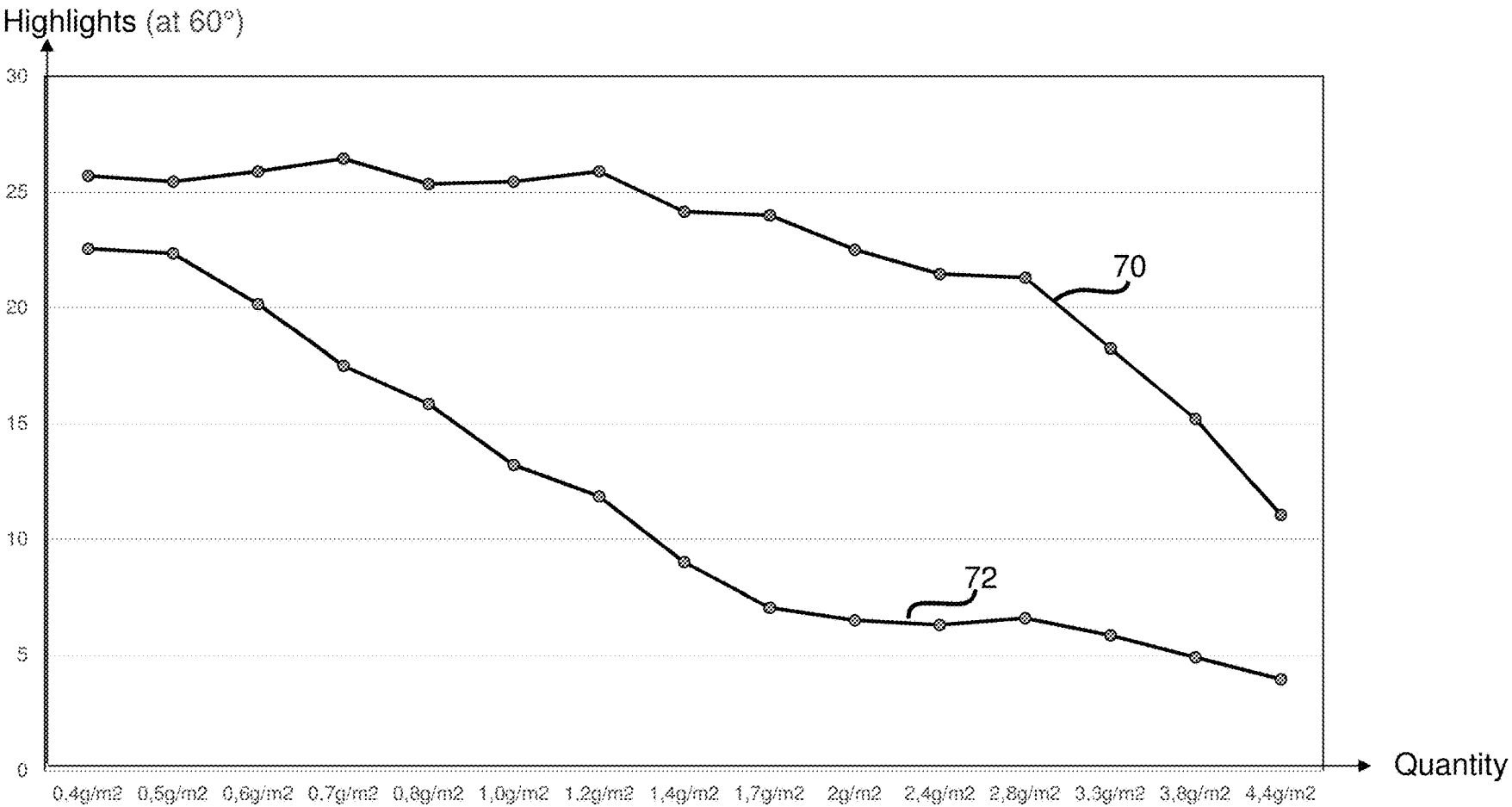
FIG. 7 is a diagram with the curve of the gloss of the surface of a first recording medium provided with a varnish layer, and of a second recording medium, depending on the quantity of coating substance applied before printing to the recording medium, according to an exemplary embodiment.

FIG. 7 shows a diagram with the curve 70 of the gloss of the surface of a first recording medium provided with a varnish layer 34, and the curve 72 of the gloss of the surface of a second recording medium provided with a varnish layer 34, depending on the quantity of a coating substance that is applied before printing to the recording medium 12. The quantity of the applied coating substance is hereby indicated in $g/m^2$ on the x-axis. The measured gloss points given a setting of 60° at the measurement device is plotted on the y-axis. Both the recording medium 12 of the curve 70 and the recording medium 12 of the curve 72 are coated papers, but with different properties. In both papers, the gloss level (the gloss points) of the applied varnish layer 34 decreases with increasing quantity of the applied coating substance, so that the gloss level of the surface of the varnish layer 34 may be influenced and controlled in a targeted manner simply via the application of a corresponding quantity of the coating substance before application of the varnish layer, in particular before application of the print image onto the recording medium 12.

Water-based varnishes may be especially advantageously used as varnishes for generating the varnish layer 34. The varnish layer is in particular applied after the drying of the applied coating substance and/or after the printing of the color separations on the recording medium 12. The varnish layer 34 may in particular be dried with the aid of infrared heating units and/or blowers. Recording media 12 may be both recording media in the form of webs or recording media in the form of sheets. The recording media in the form of sheets may in particular also be cardboard articles, in particular corrugated paper.

In general, the quantity of the applied coating substance can influence the roughness of the varnish layer 34 applied later, so that regions with relatively rough surface and regions with relatively smooth surface may be generated that have different optical properties due to their different surface. The printed print image with the coating substance may continue to be used as an invisible security feature that becomes visible due to a varnish layer 34 applied during the examination of the document. Invisible security features can hereby be generated in a simple manner.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 printing device
12 recording medium
14, 16, 18 guide elements
20 roll
22 digital printing unit, coating substance
24, 26, 28, 30 digital printing unit, color separation
32, 50 print group for varnish layer
31 controller
32 arrangement (applicator)
34 varnish layer
36 counter-pressure roller
38 printing roller
40 anilox roller
42 varnish reserve
44 blade
46 capture reservoir
48 pump
50 arrangement (applicator)
52 region of the recording medium having a first quantity of coating substance per area unit
54 region of the recording medium having a second quantity of coating substance per area unit
56 region of the recording medium without coating substance
60 print image
62 region of the varnish layer having a first gloss property
64 region of the varnish layer having a second gloss property
66 region of the varnish layer having a third gloss property
67 incident light rays
68 light path
69 reflected light rays
70, 72 curve progression
P1 transport direction

The invention claimed is:

1. A method for influencing an optical property of a varnish layer to be applied onto a recording medium on which a print image is printed by a printing device, the method comprising:

digitally printing a coating substance onto the recording medium before a printing of at least one color separation of the print image on the recording medium; and adjusting a quantity of the coating substance applied per area unit based on a desired optical property of a varnish layer to be applied thereafter.

2. The method according to claim 1, wherein the coating substance is applied in a liquid state onto the recording medium.

3. The method according to claim 1, wherein at least dot regions having a first surface energy and dot regions of a second surface energy are generated based on the quantity of coating substance applied onto the recording medium.

4. The method according to claim 1, wherein the area unit corresponds to a printable dot region of a digital printer configured to apply the coating substance.

5. The method according to claim 1, wherein:

a first quantity of the coating substance is applied onto a first surface region of the recording;

a second quantity of the coating substance is applied onto a second surface region of the recording medium; and the varnish layer subsequently applied onto the first surface region has a first optical property, and the varnish layer subsequently applied onto the second surface region has a second optical property.

6. The method according to claim 1, wherein the optical property is a reflection property of the varnish layer applied onto a respective surface region.

7. The method according to claim 1, wherein the coating substance is a primer configured to reduce a bleeding of colorants of different color separations of the print image to be printed on the recording medium.

8. The method according to claim 1, wherein the coating substance contains an aqueous saline solution or is an aqueous saline solution, the saline solution containing magnesium nitrate or magnesium sulfate.

9. The method according to claim 1, wherein the coating substance is a polyurethane-based coating substance.

10. The method according to claim 1, wherein the coating substance generates a colorless layer on the recording medium.

11. The method according to claim 1, wherein the varnish layer is generated with uniform thickness on the printed recording medium.

12. The method according to claim 1, wherein the varnish layer is generated on the printed recording medium by applying a varnish layer on a shell surface of a printing roller with a uniform varnish layer thickness in a contact region with the recording medium.

13. The method according to claim 1, wherein the varnish layer is generated with uniform varnish layer thickness on the printed recording medium in a spraying process.

14. The method according to claim 1, further comprising:

generating print data configured to generate a visible coating substance image in a page description language, and processing, by a controller, the print data to control a digital printer configured to print the coating substance image.

15. A non-transitory computer-readable storage medium with an executable program stored thereon, that when executed, instructs a processor to perform the method of claim 1.

16. A printing device, comprising:

a first digital printer configured to apply a coating substance onto a recording medium;

at least one second digital printer configured to print at least one color separation of a print image to be generated on the recording medium; and a controller configured to adjust a quantity of the coating substance applied by the first digital printer per area unit based on a desired optical property of a varnish layer to be applied after the printing of the at least one color separation of the print image.

* * * * *